US010897668B1

(12) United States Patent
Miller et al.

(10) Patent No.: US 10,897,668 B1
(45) **Date of Patent: *Jan. 19, 2021**

(54) CUSTOMIZED SOUND FIELD FOR INCREASED PRIVACY

(71) Applicant: Facebook Technologies, LLC, Menlo Park, CA (US)

(72) Inventors: Antonio John Miller, Woodinville, WA (US); Jacob Ryan Donley, Kirkland, WA (US); Scott Porter, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/867,406

(22) Filed: May 5, 2020

Related U.S. Application Data

(63) Continuation of application No. 16/221,864, filed on Dec. 17, 2018, now Pat. No. 10,728,655.

(51) Int. Cl.

| | |
|---|---|
| ***H04R 3/00*** | (2006.01) |
| ***H04R 1/10*** | (2006.01) |
| ***G10L 25/78*** | (2013.01) |
| ***H04R 1/40*** | (2006.01) |

(52) U.S. Cl.
CPC ..... *H04R 3/005* (2013.01); *G10L 25/78* (2013.01); *H04R 1/1041* (2013.01); *H04R 1/403* (2013.01); *H04R 1/406* (2013.01)

(58) Field of Classification Search
CPC ..... H04R 3/00
See application file for complete search history.

(56) References Cited

U.S. PATENT DOCUMENTS

| | | | |
|---|---|---|---|
| 9,263,023 | B2 | 2/2016 | Anazawa |
| 9,948,256 | B1 | 4/2018 | Dow et al. |
| 2004/0209654 | A1 | 10/2004 | Cheung et al. |
| 2006/0109983 | A1 | 5/2006 | Young et al. |
| 2007/0135176 | A1 | 6/2007 | Ho et al. |

(Continued)

FOREIGN PATENT DOCUMENTS

| | | | |
|---|---|---|---|
| EP | 3413589 | A1 | 12/2018 |
| WO | WO 2015/103578 | A1 | 7/2015 |

OTHER PUBLICATIONS

PCT International Search Report and Written Opinion, PCT Application No. PCT/US2020/025942, dated Jun. 23, 2020, 12 pages.

(Continued)

*Primary Examiner* — Olisa Anwah
(74) *Attorney, Agent, or Firm* — Fenwick & West LLP

(57) ABSTRACT

An audio system for customizing sound fields for increased user privacy. A microphone array of a headset detects sounds from one or more sound sources in a local area of the headset. The audio system estimates array transfer functions (ATFs) associated with the sounds, and determines determining sound field reproduction filters for a loudspeaker array of the headset using the ATFs. The audio system presents audio content, via the loudspeaker array, based in part on the sound field reproduction filters. The presented audio content has a sound field that has a reduced amplitude in a first damped region of the local area that includes a first sound source of the one or more sound sources.

20 Claims, 5 Drawing Sheets

(56) References Cited

U.S. PATENT DOCUMENTS

| | | | | |
|---|---|---|---|---|
| 2013/0201397 | A1 | 8/2013 | Ayoub et al. | |
| 2015/0057999 | A1 | 2/2015 | Leorin et al. | |
| 2015/0195641 | A1 | 7/2015 | Di Censo et al. | |
| 2016/0071526 | A1 | 3/2016 | Wingate et al. | |
| 2016/0261532 | A1 | 9/2016 | Garbin et al. | |
| 2018/0359572 | A1 | 12/2018 | Jensen et al. | |
| 2019/0069083 | A1 | 2/2019 | Salehin et al. | |
| 2019/0394564 | A1* | 12/2019 | Mehra | H04S 7/30 |

OTHER PUBLICATIONS

United States Office Action, U.S. Appl. No. 16/379,450, dated Aug. 20, 2020, 12 pages.

* cited by examiner

CUSTOMIZED SOUND FIELD FOR INCREASED PRIVACY

CROSS REFERENCE TO RELATED APPLICATIONS

This application is a continuation of co-pending U.S. application Ser. No. 16/221,864, filed Dec. 17, 2018, which is incorporated by reference in its entirety.

BACKGROUND

The present disclosure generally relates to sound field customization, and specifically relates to creating custom sound fields for increased privacy.

Conventional systems may use headphones to present audio content in a private manner to a user, but headphones occlude the ear canal and are undesirable for some artificial reality environments (e.g., augmented reality) where being able to hear sounds in the local area can be important. Generating audio content over air for a user within a local area, while minimizing the exposure of others in the local area to that audio content is difficult due to a lack of control over far-field radiated sound. Conventional systems are not able to dynamically customize a sound field to a user within their local environment.

SUMMARY

A method for generating customized sound fields for increased user privacy. The method detects, via a microphone array of a headset, sounds from one or more sound sources in a local area of the headset. Array transfer functions (ATFs) associated with the sounds are estimated, and sound field reproduction filters are determined. The sound field reproduction filters are for a loudspeaker array of the headset using the ATFs. Audio content is presented, via the loudspeaker array, based in part on the sound field reproduction filters. The presented audio content has a sound field that has a reduced amplitude in a first damped region of the local area that includes a first sound source of the one or more sound sources. A damped region may also be referred to as a quiet zone or a dark zone The method may be performed by an audio system. For example, an audio system that is part of a headset (e.g., near-eye display, head-mounted display). The audio system includes a microphone array, a controller, and a loudspeaker array.

Figure 1:
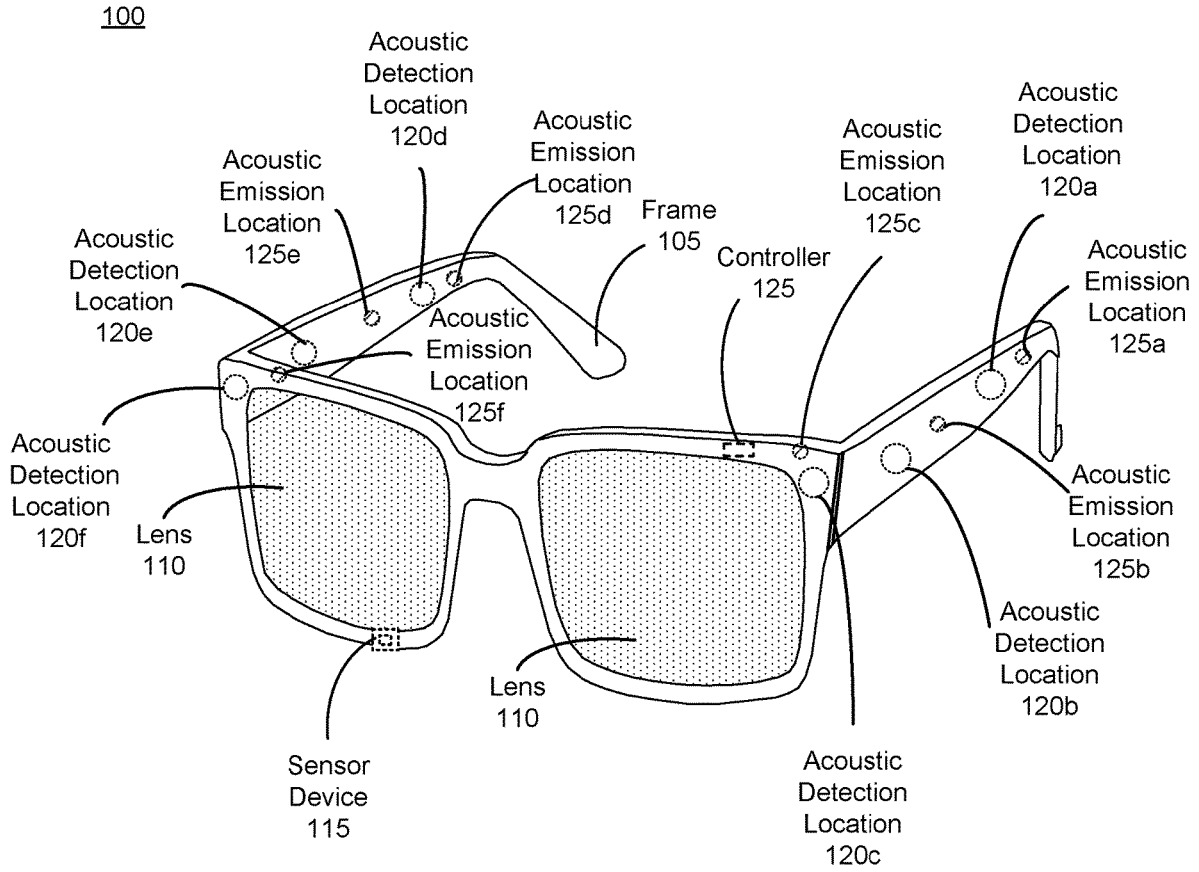
FIG. 1 is a diagram of a headset, in accordance with one or more embodiments.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

An audio system for generating customized sound fields for increased user privacy. The audio system may be part of a headset (e.g., near-eye display or a head-mounted display). The audio system includes a microphone array, a controller, and a loudspeaker array. The microphone array detects sounds from one or more sound sources in a local area of the headset. The controller estimates array transfer functions (ATFs) associated with the sounds. In some embodiments, the controller may also classify the determined ATFs based on predicted types of the one or more sound sources as human type (e.g., a person talking on a phone, a person sneezing, a person laughing, a person coughing, etc.) or non-human (e.g., a fan, an air-conditioning unit, a door closing, etc.). The controller determines sound field reproduction filters for the loudspeaker array of the headset using the ATFs, and in some cases the determination is based in part on classifications of the one or more sound sources. The loudspeaker array presents audio content based in part on the sound field reproduction filters.

The presented audio content has a sound field that has a reduced amplitude in a first damped region of the local area that includes a first sound source (e.g., a person, source classified as human type) of the one or more sound sources. The reduced amplitude in the first damped region may be significantly less than the amplitude experienced by the user, and in some cases may be a null in the sound field where no audio content is perceivable. Accordingly, the headset is able to generate a customized sound field within the local area that provides the audio content to the user while increasing the user's privacy (i.e., mitigating/reducing the audio content in areas occupied by other people). Moreover, as a sound source (e.g., speaker, sources classified as human type) moves relative to the audio system within the local area, the audio system can dynamically adjust the sound field so that it is mitigated in a damped region occupied by the sound source (e.g., placing a null in the portion of the local area occupied by the sound source).

Note that in some embodiments, the loudspeaker array on the headset does not include speakers that obstruct the ear canal (e.g., earbuds or headphones). This allows the user to hear sound from sources in the local area concurrent with audio content presented by the loudspeaker array. And as the audio system dynamically can control locations of regions of reduced amplitude (e.g., damped regions) within the sound field, the audio system can increase privacy of the user by matching the regions to locations of people within the local area.

Various embodiments may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

FIG. 1 is an example illustrating a headset 100 including an audio system, according to one or more embodiments. The headset 100 presents media to a user. In one embodiment, the headset 100 may be a near-eye display (NED). In another embodiment, the headset 100 may be a head-mounted display (HMD). In general, the headset may be worn on the face of a user such that content (e.g., media content) is presented using one or both lens 110 of the headset. However, the headset 100 may also be used such that media content is presented to a user in a different manner. Examples of media content presented by the headset 100 include one or more images, video, audio, or some combination thereof. The headset 100 includes the audio system, and may include, among other components, a frame 105, a lens 110, and a sensor device 115. While FIG. 1 illustrates the components of the headset 100 in example locations on the headset 100, the components may be located elsewhere on the headset 100, on a peripheral device paired with the headset 100, or some combination thereof.

The headset 100 may correct or enhance the vision of a user, protect the eye of a user, or provide images to a user. The headset 100 may be eyeglasses which correct for defects in a user's eyesight. The headset 100 may be sunglasses which protect a user's eye from the sun. The headset 100 may be safety glasses which protect a user's eye from impact. The headset 100 may be a night vision device or infrared goggles to enhance a user's vision at night. The headset 100 may be a near-eye display that produces artificial reality content for the user. Alternatively, the headset 100 may not include a lens 110 and may be a frame 105 with an audio system that provides audio content (e.g., music, radio, podcasts) to a user.

The lens 110 provides or transmits light to a user wearing the headset 100. The lens 110 may be prescription lens (e.g., single vision, bifocal and trifocal, or progressive) to help correct for defects in a user's eyesight. The prescription lens transmits ambient light to the user wearing the headset 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 is discussed with regards to FIG. 5.

In some embodiments, the headset 100 may include a depth camera assembly (DCA) (not shown) that captures data describing depth information for a local area surrounding the headset 100. In some embodiments, the DCA may include a light projector (e.g., structured light and/or flash illumination for time-of-flight), an imaging device, and a controller. The captured data may be images captured by the imaging device of light projected onto the local area by the light projector. In one embodiment, the DCA may include two or more cameras that are oriented to capture portions of the local area in stereo and a controller. The captured data may be images captured by the two or more cameras of the local area in stereo. The controller computes the depth information of the local area using the captured data and depth determination techniques (e.g., structured light, time-of-flight, stereo imaging, etc.). Based on the depth information, the controller determines absolute positional information of the headset 100 within the local area. The DCA may be integrated with the headset 100 or may be positioned within the local area external to the headset 100. In the latter embodiment, the controller of the DCA may transmit the depth information to the controller 125 of the headset 100. In addition, the sensor device 115 generates one or more measurements signals in response to motion of the headset 100. The sensor device 115 may be location on a portion of the frame 105 of the headset 100.

The sensor device 115 may include a position sensor, an inertial measurement unit (IMU), or both. Some embodiments of the headset 100 may or may not include the sensor device 115 or may include more than one sensor device 115. In embodiments in which the sensor device 115 includes an IMU, the IMU generates IMU data based on measurement signals from the sensor device 115. Examples of sensor devices 115 include: one or more accelerometers, one or more gyroscopes, one or more magnetometers, another suitable type of sensor that detects motion, a type of sensor used for error correction of the IMU, or some combination thereof. The sensor device 115 may be located external to the IMU, internal to the IMU, or some combination thereof.

Based on the one or more measurement signals, the sensor device 115 estimates a current position of the headset 100 relative to an initial position of the headset 100. The estimated position may include a location of the headset 100 and/or an orientation of the headset 100 or the user's head wearing the headset 100, or some combination thereof. The orientation may correspond to a position of each ear relative to the reference point. In some embodiments, the sensor device 115 uses the depth information and/or the absolute positional information from a DCA to estimate the current position of the headset 100. The sensor device 115 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 100 from the sampled data. For example, the IMU integrates the measurement signals received from the accelerometers over time to estimate a velocity vector and integrates the velocity vector over time to determine an estimated position of a reference point on the headset 100. The reference point is a point that may be used to describe the position of the headset 100. While the reference point may generally be defined as a point in space, however, in practice the reference point is defined as a point within the headset 100.

The audio system generates customized sound fields for increased user privacy. The audio system comprises a microphone array, a controller, and a loudspeaker array. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The microphone arrays record sounds within a local area of the headset 100. A local area is an environment surrounding the headset 100. For example, the local area may be a room that a user wearing the headset 100 is inside, or the user wearing the headset 100 may be outside and the local area is an outside area in which the microphone array is able to detect sounds. The microphone array comprises a plurality of acoustic detection locations that are positioned on the headset 100. An acoustic detection location includes either an acoustic sensor or a port. A port is an aperture in the frame 105 of the headset 100. In the case of an acoustic detection location, the port provides an incoupling point for sound from a local area to an acoustic waveguide that guides the sounds to an acoustic sensor. An acoustic sensor captures sounds emitted from one or more sound sources in the local area (e.g., a room). Each acoustic sensor is configured to detect sound and convert the detected sound into an electronic format (analog or digital). The acoustic sensors may be acoustic wave sensors, microphones, sound transducers, or similar sensors that are suitable for detecting sounds.

In the illustrated configuration, the microphone array comprises a plurality of acoustic detection locations on the headset 100, for example acoustic detection locations 120*a*, 120*b*, 120*c*, 120*d*, 120*e*, and 120*f*. The acoustic detection locations may be placed on an exterior surface of the headset 100, placed on an interior surface of the headset 100, separate from the headset 100 (e.g., part of some other device), or some combination thereof. In some embodiments, one or more of the acoustic detection locations 120*a-f* may also be placed in an ear canal of each ear. The configuration of the acoustic detection locations of the microphone array may vary from the configuration described with reference to FIG. 1. The number and/or locations of acoustic detection locations may be different from what is shown in FIG. 1. For example, the number of acoustic detection locations may be increased to increase the amount of audio information collected and the sensitivity and/or accuracy of the information. The acoustic detection locations may be oriented such that the microphone array is able to detect sounds in a wide range of directions surrounding the user wearing the headset 100. Each detected sound may be associated with a frequency, an amplitude, a phase, a time, a duration, or some combination thereof.

The controller estimates array transfer functions (ATFs) associated with the sounds. In some embodiments, the controller may also classify the determined ATFs based on predicted types of the one or more sound sources as human type (e.g., a person talking on a phone) or non-human type (e.g., a fan, an air-conditioning unit, etc.). The controller determines sound field reproduction filters for the loudspeaker array of the headset using the ATFs, and in some cases classifications of the one or more sound sources. Operations of the controller are described in detail below with regard to FIG. 3.

The loudspeaker array presents audio content based in part on the sound field reproduction filters. The loudspeaker array comprises a plurality of acoustic emission locations on the headset 100. An acoustic emission location is a location of a speaker or a port in the frame 105 of the headset 100. In the case of an acoustic emission location, the port provides an outcoupling point of sound from an acoustic waveguide that separates a speaker of the loudspeaker array from the port. Sound emitted from the speaker travels through the acoustic waveguide and is then emitted by the port into the local area.

In the illustrated embodiment, the loudspeaker array includes acoustic emission locations 125*a*, 125*b*, 125*c*, 125*d*, 125*e*, and 125*f*. In other embodiments, the loudspeaker array may include a different number of acoustic emission locations (more or less) and they may be placed at different locations on the frame 105. For example, the loudspeaker array may include speakers that cover the ears of the user (e.g., headphones or earbuds). In the illustrated embodiment, the acoustic emission locations 125*a*-125*f* are placed on an exterior surface (i.e., a surface that does not face the user) of the frame 105. In alternate embodiments some or all of the acoustic emission locations may be placed on an interior surface (a surface that faces the user) of the frame 105. Increasing the number of acoustic emission locations may improve an accuracy (e.g., where a damped region is located) and/or resolution (e.g., how close an actual shape of a damped region is to a target shape) of a sound field associated with the audio content.

In some embodiments, each acoustic detection location is substantially collocated with a corresponding acoustic emission location. Substantially collocated refers to each acoustic detection location being less than a quarter wavelength away from the corresponding acoustic emission location. The number and/or locations of acoustic detection locations and corresponding acoustic emission locations may be different from what is shown in FIG. 1. For example, the number of acoustic detection locations and corresponding acoustic emission locations may be increased to increase control and/or accuracy over a generated sound field.

The audio content presented by the loudspeaker array has a sound field that can have a reduced amplitude in damped regions within the local area that include sound sources (e.g., a person, source classified as human type). The reduced amplitude in the first damped region may be significantly less than the amplitude experienced by the user, and in some cases may be a null in the sound field where no audio content is perceivable. Accordingly, the headset is able to generate a sound field within the local area that provides the audio content to the user while increasing the user's privacy (i.e., mitigating/reducing the audio content in areas occupied by other people).

In the illustrated configuration the audio system is embedded into a NED worn by a user. In alternate embodiments, the audio system may be embedded into a head-mounted display (HMD) worn by a user. Although the description above discusses the audio assemblies as embedded into headsets worn by a user, it would be obvious to a person skilled in the art, that the audio assemblies could be embedded into different headsets which could be worn by users elsewhere or operated by users without being worn.

Figure 2:
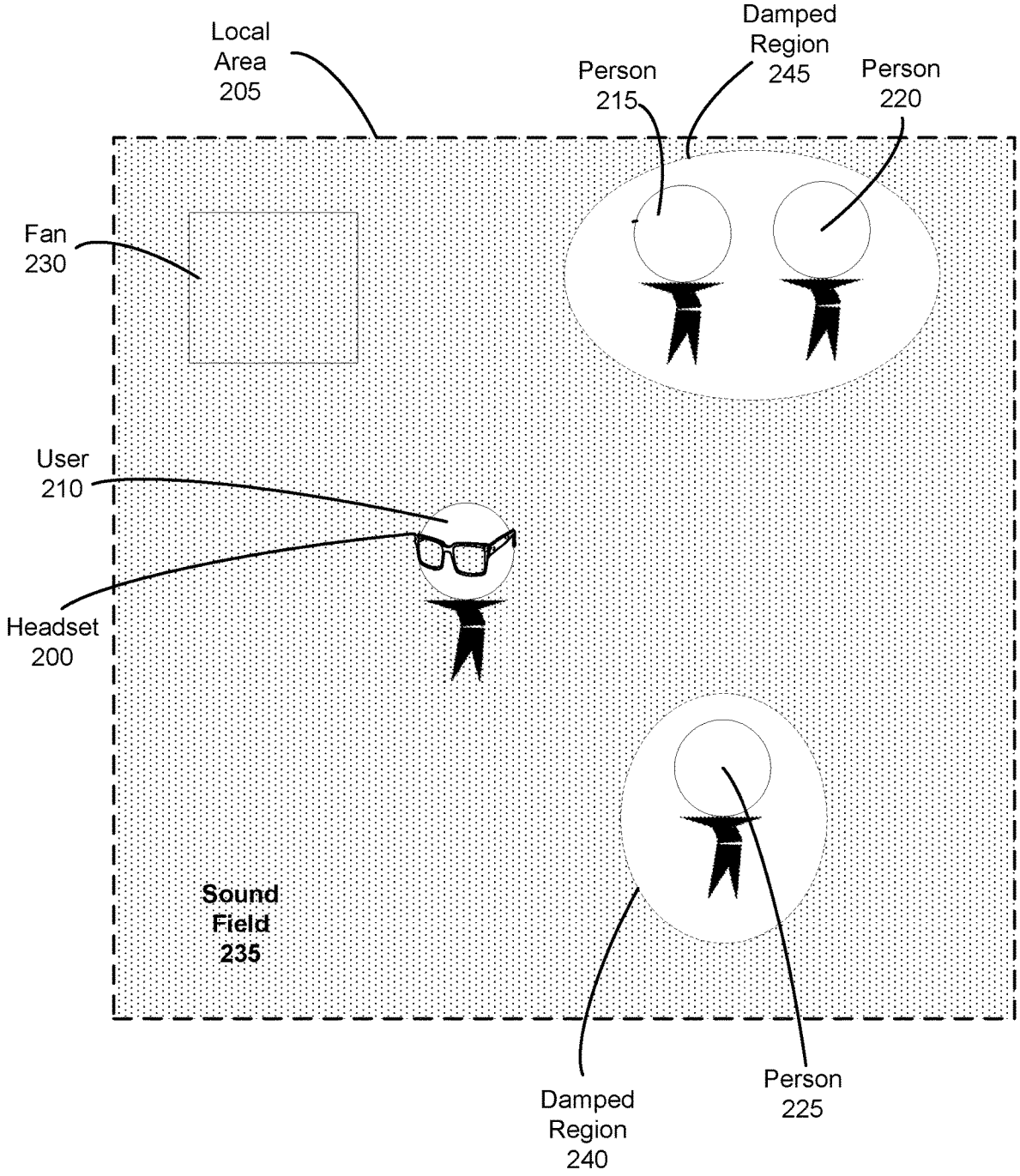
FIG. 2 illustrates a headset providing a customized sound field within a local area, in accordance with one or more embodiments.

FIG. 2 illustrates a headset 200 providing a customized sound field 235 within a local area 205, in accordance with one or more embodiments. The headset 200 is worn by a user 210 and includes an audio system (e.g., as described in FIGS. 1 and 3-5).

The local area 205 includes a plurality of sound sources, specifically, a person 215, a person 220, a person 225, and a fan 230. As described in detail below with regard to FIG. 3, the headset 200 presents audio content that has a sound field 235 within the local area 205. The sound field 235 includes a damped region 240 at a location of the person 225 and a damped region 245 at a location of the person 215 and the person 220.

A damped region is a location in a sound field where the audio content is substantially reduced relative to portions of the sound field bordering the damped region. The damped region may be defined as having an acoustic amplitude below a threshold level from ambient sound within that environment. The threshold level that defines the damped region may additionally depend on the number of acoustic detection locations and acoustic emission locations. In some embodiments, the gradient between the ambient sound and the threshold level may drop off exponentially. The gradient may be tied to the wavelength or wavenumber of the specific sound field. The size of the damped regions is determined based on the wavelength of the received sound, which is encoded in the ATF and used for the sound field reproduction filters. In defining the sound field reproduction filters, there may also be a parameter where the level of the damped region inversely depends on a size of the region, e.g., rather than suppressing more and more below a perceivable threshold, the algorithm may use the ambient sound levels to determine a new minimum quiet level to suppress at which any leaked content would not be perceived by other persons, and when this constraint on a perfectly quiet is alleviated, the algorithm will naturally produce a larger size damped region around the persons.

In some embodiments, the damped region may be a null. A null is a location in a sound field where an amplitude is essentially zero. Accordingly, the person 215, the person 220, and the person 225 are in damped regions that reduce an amplitude of the audio content, and in some cases it is low enough such that they would not be able to hear the audio content.

Moreover, in some embodiments, as relative positioning changes between the audio system and one or more of the persons 215, 220, 225 changes the audio system dynamically adjusts positions of damped regions to continue to include the persons 215, 220, 225. For example, if the person 225 walks towards the person 215, the audio system dynamically updates the sound field such that the damped region 240 moves with the person 225.

Note that in the illustrated embodiment, the fan 230 is not in a damped region. This is because the audio system classified the fan 230 as a source that is of a non-human type, whereas the audio system classified the persons 215, 220, and 225 as sources of a human type. And the audio system generated the sound field 235 based in part on the classified types of the sound sources. A sound source classified as non-human type is generally something that emits sound and is not a person. For example, a non-human type source may include a television, a radio, an air conditioning unit, a fan, etc. In contrast, a sound source classified as human type is generally a person. Although in some embodiments, a sound source classified as a human type may be a device producing sounds similar to those produced directly by a person (e.g., a phone, a conferencing device, a telecommuting robot). Additionally, in some embodiments, the user 210 may manually identify objects and/or people as a human type or a non-human type.

In some embodiments, the user 210 may also manually position damped regions within the sound field 235. For example, the headset 200 may include a user interface and/or be coupled to a user interface (e.g., an application on mobile device in communication with the headset 220) that allows the user 210 to manually position one or more damped regions within the local area 205. In some embodiments, the user interface may also allow a user to control a size of the damped region within the local area 205.

As the audio system can control locations of the damped regions within the sound field, the audio system can increase privacy of the user by matching the damped regions to locations of people within the local area. The audio system facilitates the user 210 being able to experience the audio content freely (e.g., without headphones and/or ear buds) and in a private manner (e.g., reduces an amplitude (i.e., volume) of the audio content received by the persons 215, 220, 225).

Figure 3:
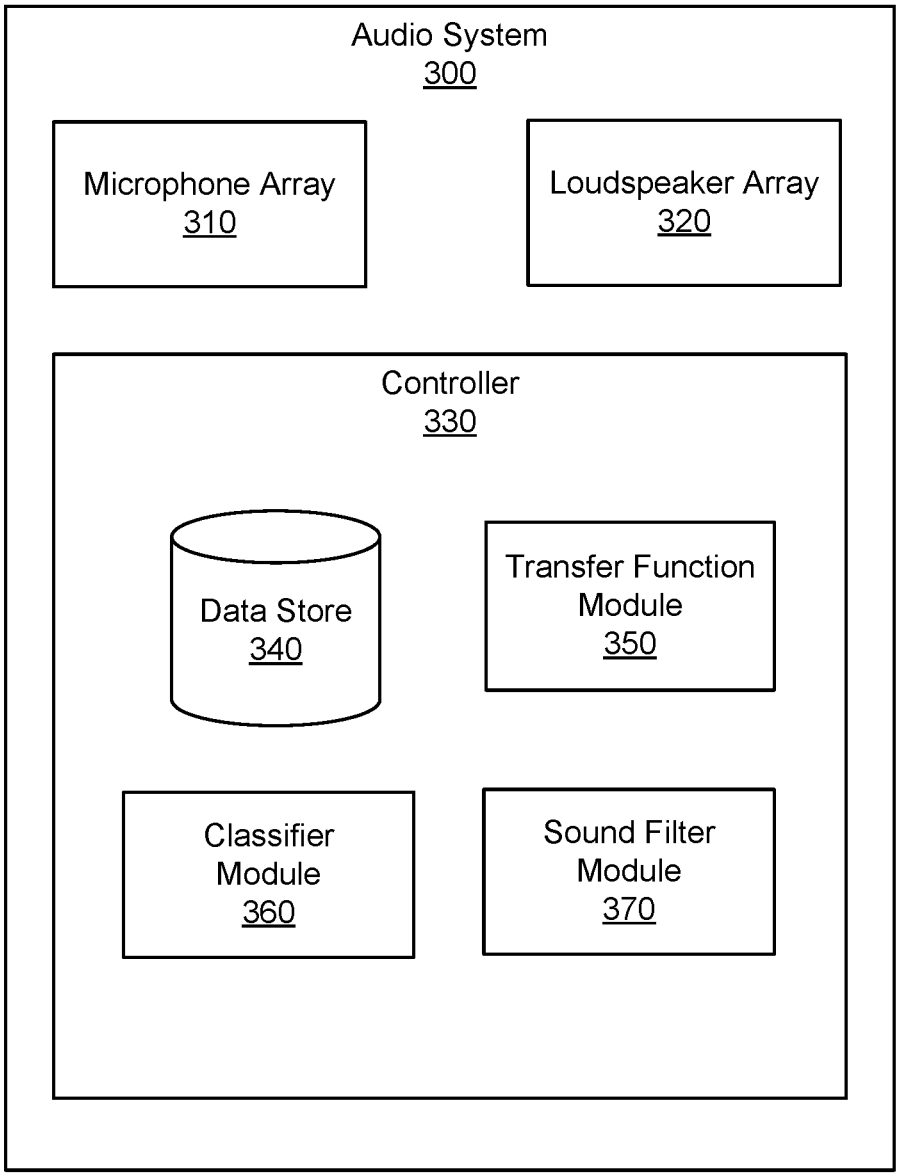
FIG. 3 is a block diagram of an example audio system, according to one or more embodiments.

FIG. 3 is a block diagram of an audio system 300, in accordance with one or more embodiments. The audio system 300 may be a component of a headset providing audio content to the user. The audio system of FIGS. 1 and 2 may be an embodiment of the audio system 300. The audio system 300 includes a microphone array 310, a loudspeaker array 320, and a controller 330. Some embodiments of the audio system 300 have different components than those described here. Similarly, the functions can be distributed among the components in a different manner than is described here. And in some embodiments, some of the functions of the audio system may be part of different components (e.g., some may be part of a headset and some may be part of a console and/or server).

The microphone array 310 detects sounds from one or more sound sources in a local area. The microphone array 310 is part of a headset (e.g., the headset 100). The microphone array 310 includes a plurality of acoustic detection locations. An acoustic detection location is a position on the headset that includes either an acoustic sensor or a port. The port is an aperture in a frame of the headset. In the case of an acoustic detection location, the port provides an incoupling point for sound from a local area to an acoustic waveguide that guides the sounds to an acoustic sensor. The plurality of acoustic detection locations are located on the headset, and are configured to capture sounds emitted from one or more sound sources in the local area. The plurality of acoustic detection locations may be positioned on the headset to detect sound sources in all directions relative to the user. In some embodiments, the plurality acoustic detection locations may be positioned to provide enhanced coverage in certain directions relative to other directions. Increasing the number of acoustic detection locations comprising the microphone array may improve the accuracy of directional information from the microphone array to the one or more sound sources in the local area. The acoustic sensors detect air pressure variations caused by a sound wave. Each acoustic sensor is configured to detect sound and convert the detected sound into an electronic format (analog or digital). The acoustic sensors may be acoustic wave sensors, microphones, sound transducers, or similar sensors that are suitable for detecting sounds.

The loudspeaker array 320 presents audio content. The presented audio content is based in part on sound field reproduction filters generated by the controller 330. The presented audio content has a sound field that may have one or more reduced amplitudes regions of a local area that include sound sources. An example sound field is discussed above with regard to FIG. 2. The loudspeaker array 320 includes a plurality of acoustic emission locations on the headset. An acoustic emission location is a location of a speaker or a port in a frame of the headset. In the case of an acoustic emission location, the port provides an outcoupling point of sound from an acoustic waveguide that separates a speaker of the loudspeaker array from the port. Sound emitted from the speaker travels through the acoustic waveguide and is then emitted by the port into the local area.

A speaker may be, e.g., a moving coil transducer, a piezoelectric transducer, some other device that generates an acoustic pressure wave using an electric signal, or some combination thereof. In some embodiments, the loudspeaker array 320 also includes speakers that cover each ear (e.g., headphones, earbuds, etc.). In other embodiments, the loudspeaker array 320 does not include any acoustic emission locations that occlude the ears of a user.

Each acoustic detection location may be substantially collocated with a corresponding acoustic emission location. And substantially collocated refers to each acoustic detection location being less than a quarter wavelength away from the corresponding acoustic emission location, e.g., wherein the smallest wavelength comes from the highest frequency distinguishable by the audio system 300. The reciprocity theorem states that the free-field Green's function is dependent on the distance between the source/receiver pair and not the order in which that pair is described, thus collocation is optimal according to such an approach. This allows multichannel recordings on the microphone array 310 to represent an equivalent acoustic loudspeaker array 320 reproduction path back out into the local area. In other embodiments, the acoustic detection location and the corresponding acoustic emission location may not be substantially collocated; however, there may be a compromise in performance with the pair of locations not being substantially collocated or at least within a quarter wavelength.

The controller 330 controls operation of the audio system 300. The controller 330 may include a data store 340, a transfer function module 350, a classifier module 360, and a sound filter module 270. Some embodiments of the controller 330 have different components than those described here. Similarly, the functions can be distributed among the components in a different manner than is described here. And in some embodiments, some of the functions of the controller 330 may be performed by different components (e.g., some may be performed at the headset and some may be performed at a console and/or server).

The data store 340 stores data for use by the audio system 300. Data in the data store 340 may include any combination of sounds recorded from a local area, audio content, transfer functions for one or more acoustic sensors, array transfer functions for the microphone array 310, types of sound sources, optimization constraints, sound field reproduction filters, a map of the local area, other data relevant for use by the audio system 300, or some combination thereof.

The transfer function module 350 estimates array transfer functions (ATFs) using the detected sounds from sound sources in a local area of the headset. The transfer function module 350 identifies that a sound source is present in sounds captured by the microphone array 310. In some embodiments, the transfer function module 350 identifies sound sources by determining that certain sounds are above a threshold, e.g., an ambient sound level. In other embodiments, the transfer function module 350 identifies sound sources with a machine learning algorithm, e.g., a single channel pre-trained machine learning based classifier may be implemented to classify between the two types of sources. The transfer function module 350 may, e.g., identify a sound source as a particular range of frequencies that have amplitude that is larger than a baseline value for the local area. For each identified sound source, the transfer function module 350 determines a transfer function for each of the acoustic sensors. A transfer function characterizes how an acoustic sensor receives a sound from a point in the local area. Specifically, the transfer function defines a relationship between parameters of the sound at its source location (i.e., location of the sound source emitting the sound) and parameters at which the acoustic sensor detected the sound. Parameters associated with the sound may include frequency, amplitude, time, phase, duration, a direction of arrival (DoA) estimation, etc. In some embodiments, eigenvalue decomposition is used to determine a transfer function. For a given identified sound source, a collection of transfer functions for of all of the acoustic sensors in the microphone array is referred to as an ATF. An ATF characterizes how the microphone array 310 receives a sound from the sound source, and defines a relationship between parameters of the sound at the location of the sound source and the parameters at which the microphone array 310 detected the sound. In other words, the ATF describes propagation of sound from each source to each microphone and additionally propagation of sound from each acoustic emission location to some other point in space. In some embodiments, a Relative Transfer Function (RTF) is another type of ATF that is normalized by an arbitrary microphone on the array. Accordingly, if there are a plurality of identified sound sources, the transfer function module 350 determines an ATF for each respective identified sound source.

The classifier module 360 classifies the determined ATFs based on predicted types of sound sources as human type or non-human type. The classifier module 360 classifies the identified sound sources as being either a human type or a non-human type. A human type sound source is a person and/or device controlled by a person (e.g., a phone, a conferencing device, a telecommuting robot). A non-human type sound source is any sound source that is not classified as a human type sound source. A non-human type sound source may include, e.g., a television, a radio, an air conditioning unit, a fan, any sound source that is not classified as a human type sound source, or some combination thereof. The classifier module 360 determines a type of the sound source by analyzing the determined ATF associated with the identified sound source and/or sounds detected by the microphone array 310. In some embodiments of classification, the classifier module 360 performs a beamforming operation with an estimated ATF on the detected active signal. The beamforming operation reverses the natural application of the ATF to arrive at the original source signal. When using an RTF, the beamforming operation with the RTF arrives at the original source signal as heard from an arbitrary microphone, e.g., the arbitrary microphone used for the normalization of an ATF to achieve the RTF. The output of the beamformed signal is an enhanced version of the source signal. The classifier module 360 may input the enhanced signal into a classifier to determine the source type. The classifier module 360 and therefore also the associated ATF type for that particular source. Additionally, in some embodiments, the user may manually identify objects and/or people in the local area as a human type or a non-human type. For example, the user may identify a person as a human type using an interface on the headset. Once a sound source is classified as being a human type or a non-human type, the classifier module 360 associates the ATF associated with the sound source as being of the same type.

In some embodiments, prior to classification, the classifier module 360 performs signal enhancement using the ATFs associated with a sound source and the sounds detected by the microphone array 310. Signal enhancement acts to enhance sounds associated with a given identified sound source relative to other sounds detected by the microphone array 310. In some embodiments, the classifier module 360 performs a beamforming operation with an estimated ATF on the detected active signal. The beamforming operation reverses the natural application of the ATF to arrive at the original source signal. When using an RTF, the beamforming operation with the RTF arrives at the original source signal as heard from an arbitrary microphone, e.g., the arbitrary microphone used for the normalization of an ATF to achieve the RTF.

The sound filter module 370 determines sound field reproduction filters for the loudspeaker array 320 using the ATFs. The sound filter module 370 determines the sound field reproduction filters by applying an optimization algorithm to the ATFs. The optimization algorithm is subject to one or more constraints. A constraint is a requirement that can affect the results of the optimization algorithm. For example, a constraint may be, e.g., a classification of a sound source, that audio content output by the loudspeaker array 320 is provided to ears of the user, energy and/or power of a sum of the ATFs classified as human type is minimized, that audio content output by the loudspeaker array 320 has distortion less than a threshold amount at the ears of the user, some other requirement that can affect the results of the optimization algorithm, or some combination thereof. The optimization algorithm may be, e.g., a linearly constrained minimum variance (LCMV) algorithm, a minimum variance distortionless response (MVDR), or some other adaptive beamforming algorithm that determines sound field reproduction filters. In some embodiments, the optimization algorithm may also utilize a direction of arrival of sound from the identified sound sources and/or relative locations of the one or more sound sources to the headset to determine the sound field reproduction filters. The optimization algorithm outputs sound field reproduction filters. The sound filter module 370 provides the sound field reproduction filters to the loudspeaker array 320. The sound field reproduction filters, when applied to an audio signal, cause the loudspeaker array 320 to present audio content that has a specific sound field within the local area. The sound field may have, e.g., reduced amplitudes in one or more damped regions that are occupied by sound sources.

As noted above, the optimization algorithm can be constrained by a classification type of a sound source. For example, the sound filter module 370 applies the optimization algorithm to the ATFs in a manner such that an energy of a sum of energies of the ATFs classified as human type is minimized. An optimization algorithm constrained in this manner generates sound field reproduction filters such that damped areas would be located where sound sources classified as human type are present, but would not be located where sound sources classified as non-human type are present. One advantage of classification is that it can potentially reduce a number of damped regions within the sound field, thereby reducing complexity of the sound field and hardware specifications for the loudspeaker array 320 (e.g., a number of acoustic emission locations and acoustic detection locations). Reduction in the number of damped regions may also increase suppression of the damped regions used.

Note that the controller 300 is continually receiving sounds from the microphone array 310. Accordingly, the controller 330 can dynamically update (e.g., via the modules within the controller 330) the sound field reproduction filters as relative locations change between the headset and any sound sources (e.g., human type sound sources) within the local area such that the sound sources are always placed within damped regions. Additionally, the controller may be able to update the sound field reproduction filters to control a size of the damped regions.

Figure 4:
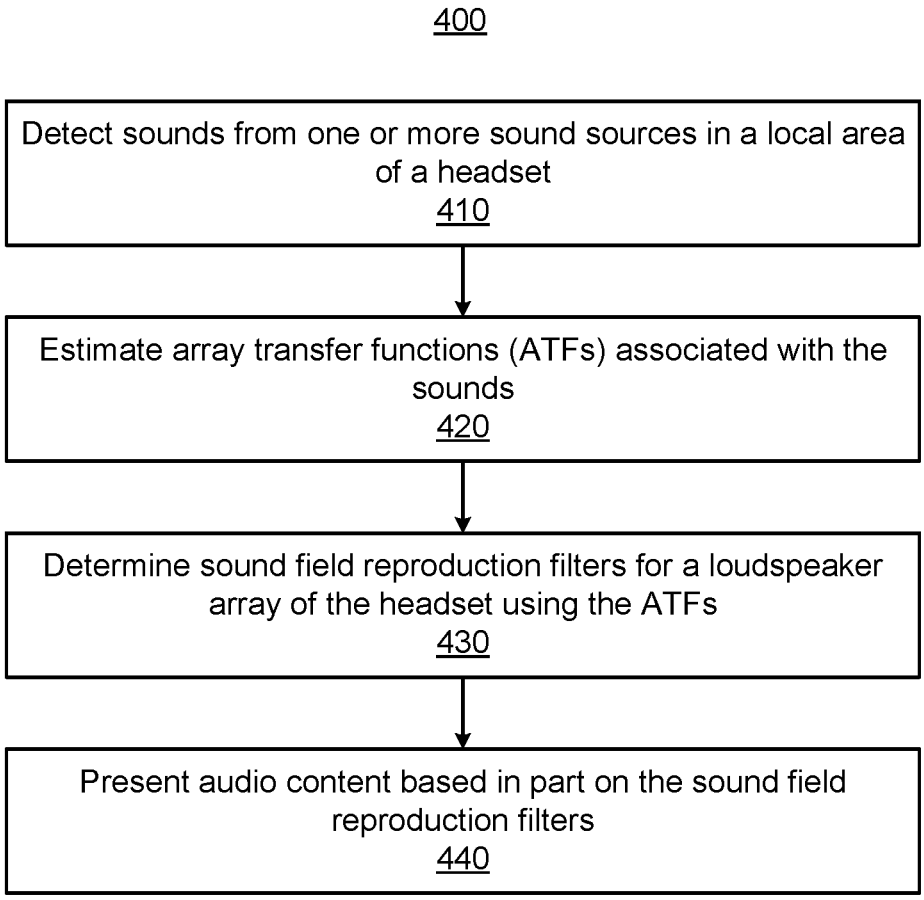
FIG. 4 is a process for creating a customized sound field, according to one or more embodiments.

FIG. 4 is a flowchart illustrating a process 400 for creating a customized sound field, in accordance with one or more embodiments. In one embodiment, the process of FIG. 4 is performed by components of an audio system (e.g., the audio system 300). Other entities may perform some or all of the steps of the process in other embodiments. Likewise, embodiments may include different and/or additional steps, or perform the steps in different orders.

The audio system 300 detects sounds from one or more sound sources in a local area of a headset (e.g., the headset 100). The audio system 300 detects the sounds using a microphone array (e.g., the microphone array 310) of the headset.

The audio system 300 estimates 310 ATFs associated with the sounds. The audio system 300 identifies that one or more sound sources are present in the sounds. For each identified sound source, the audio system 300 estimates (e.g., via eigen value decomposition) an associated ATF.

The audio system 300 determines sound field reproduction filters for a loudspeaker array (e.g., the loudspeaker array 320) of the headset using the ATFs. As discussed above with regard to FIG. 3, the audio system 300 uses an optimization algorithm to determine the sound field reproduction filters.

The audio system 300 presents audio content based in part on the sound field reproduction filters. The audio system 300 presents the audio content via the loudspeaker array. The audio system applies the sound field reproduction filters to an audio signal to produce the audio content. The audio content has a sound field that has a reduced amplitude in one or more damped regions of the local area that includes one or more sound sources. In some embodiments, the first sound source is classified as a human type (e.g., a person).

Note that the audio system can dynamically control locations of damped regions within the sound field. For example, the microphone array may detect sounds from a sound source over a first-time period and generate the sound reproduction filters based on that first-time period. The microphone array may later detect sounds over a second-time period subsequent to the first-time period—where a position of the headset relative to the sound source is different in the second-time period than a position of the headset relative to the first sound source during the first-time period. The audio system 300 then estimates an ATF associated with the sounds detected over the second-time period and updates the sound field reproduction filters for the loudspeaker array using the ATF. The audio system 300 then presents updated audio content, via the loudspeaker array, based in part on the updated sound field reproduction filters. The presented updated audio content has a sound field that has a reduced amplitude in a damped region of the local area that includes first source. In this manner the audio system 300 can dynamically place damped regions within the local area despite user movement (e.g., a location of the headset is different in the first-time period from a location of the headset in the second-time period) and/or movement of sound sources (e.g., a location of the sound source is different in the first-time period from a location of the sound source in the second-time period) within the local area.

Being able to dynamically locate and/or resize damped region facilitates the audio system 300 in providing audio content in a private manner to the user (e.g., by matching the damped regions to locations of people within the local area. In addition to providing audio content in a private manner, the audio system 300 facilitates a user being able to experience the audio content freely (e.g., without headphones and/or ear buds).

Example of an Artificial Reality System

Figure 5:
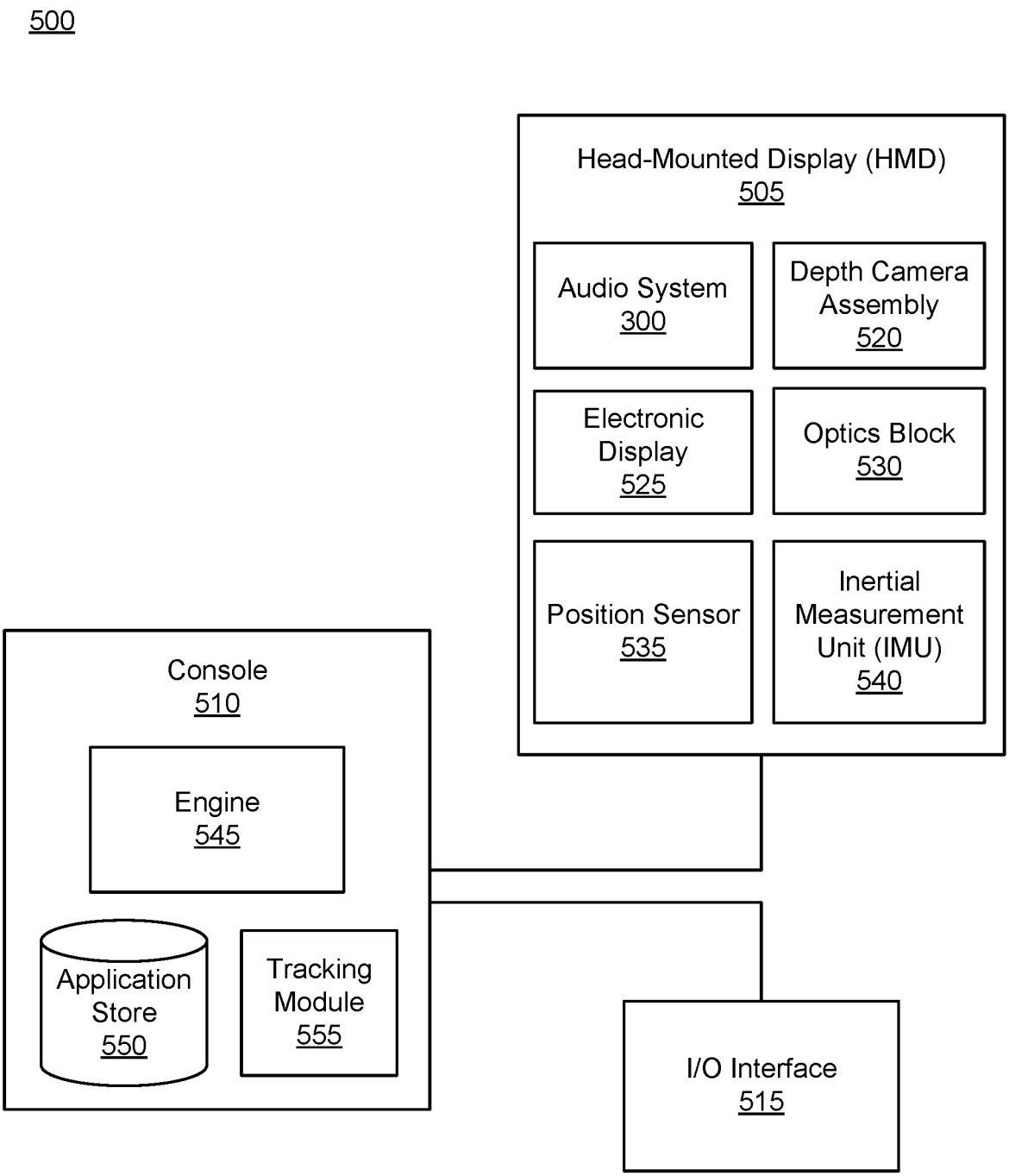
FIG. 5 is a block diagram of an example artificial reality system, according to one or more embodiments.

FIG. 5 is a system environment of a headset including the audio system 300 of FIG. 3, in accordance with one or more embodiments. The system 500 may operate in an artificial reality environment, e.g., a virtual reality, an augmented reality, a mixed reality environment, or some combination thereof. The system 500 shown by FIG. 5 comprises a headset 505 and an input/output (I/O) interface 515 that is coupled to a console 510. The headset 505 may be an embodiment of the headset 200. While FIG. 5 shows an example system 500 including one headset 505 and one I/O interface 515, in other embodiments, any number of these components may be included in the system 500. For example, there may be multiple headsets 505 each having an associated I/O interface 515 with each headset 505 and I/O interface 515 communicating with the console 510. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 is provided by the headset 505.

The headset 505 presents content to a user comprising augmented views of a physical, real-world environment with computer-generated elements (e.g., two dimensional (2D) or three dimensional (3D) images, 2D or 3D video, sound, etc.). The headset 505 may be an eyewear device or a head-mounted display. In some embodiments, the presented content includes audio content that is presented via the audio system 300 that receives audio information (e.g., an audio signal) from the headset 505, the console 510, or both, and presents audio content based on the audio information.

The headset 505 includes the audio system 300, a depth camera assembly (DCA) 520, an electronic display 525, an optics block 530, one or more position sensors 535, and an inertial measurement Unit (IMU) 540. The electronic display 525 and the optics block 530 is one embodiment of a lens 110. The position sensors 535 and the IMU 540 is one embodiment of sensor device 115. Some embodiments of the headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The audio system 300 generates a sound field that is customized for increased user privacy. As describe above with reference to FIGS. 1-4, the audio system 300 detects, via a microphone array of the audio assembly 300, sounds from one or more sound sources in a local area of the headset 505. The audio assembly 300 estimates array transfer functions (ATFs) associated with the sounds, and determines sound field reproduction filters for a loudspeaker array of the headset using the ATFs. The audio system 300 presents audio content, via a loudspeaker array, based in part on the sound field reproduction filters. The presented audio content has a sound field that has a reduced amplitude in a first damped region of the local area that includes a first sound source of the one or more sound sources.

The DCA 520 captures data describing depth information of a local environment surrounding some or all of the headset 505. The DCA 520 may include a light generator (e.g., structured light and/or a flash for time-of-flight), an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 520 can compute the depth information using the data captured by the imaging device or the DCA 520 can send this information to another device such as the console 510 that can determine the depth information using the data from the DCA 520.

In some embodiments, the audio system 300 may utilize the depth information which may aid in identifying directions of one or more potential sound sources, depth of one or more sound sources, movement of one or more sound sources, sound activity around one or more sound sources, or any combination thereof.

The electronic display 525 displays 2D or 3D images to the user in accordance with data received from the console 510. In various embodiments, the electronic display 525 comprises a single electronic display or multiple electronic displays (e.g., a display for each eye of a user). Examples of the electronic display 525 include: a liquid crystal display (LCD), an organic light emitting diode (OLED) display, an active-matrix organic light-emitting diode display (AMOLED), waveguide display, some other display, or some combination thereof.

In some embodiments, the optics block 530 magnifies image light received from the electronic display 525, corrects optical errors associated with the image light, and presents the corrected image light to a user of the headset 505. In various embodiments, the optics block 530 includes one or more optical elements. Example optical elements included in the optics block 530 include: a waveguide, an aperture, a Fresnel lens, a convex lens, a concave lens, a filter, a reflecting surface, or any other suitable optical element that affects image light. Moreover, the optics block 530 may include combinations of different optical elements. In some embodiments, one or more of the optical elements in the optics block 530 may have one or more coatings, such as partially reflective or anti-reflective coatings.

Magnification and focusing of the image light by the optics block 530 allows the electronic display 525 to be physically smaller, weigh less, and consume less power than larger displays. Additionally, magnification may increase the field of view of the content presented by the electronic display 525. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 530 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 525 for display is predistorted, and the optics block 530 corrects the distortion when it receives image light from the electronic display 525 generated based on the content.

The IMU 540 is an electronic device that generates data indicating a position of the headset 505 based on measurement signals received from one or more of the position sensors 535. A position sensor 535 generates one or more measurement signals in response to motion of the headset 505. Examples of position sensors 535 include: one or more accelerometers, one or more gyroscopes, one or more magnetometers, another suitable type of sensor that detects motion, a type of sensor used for error correction of the IMU 540, or some combination thereof. The position sensors 535 may be located external to the IMU 540, internal to the IMU 540, or some combination thereof. In one or more embodiments, the IMU 540 and/or the position sensor 535 may be monitoring devices of the monitoring assembly 320 capable of monitoring responses of the user to audio content provided by the audio system 300.

Based on the one or more measurement signals from one or more position sensors 535, the IMU 540 generates data indicating an estimated current position of the headset 505 relative to an initial position of the headset 505. For example, the position sensors 535 include multiple accelerometers to measure translational motion (forward/back, up/down, left/right) and multiple gyroscopes to measure rotational motion (e.g., pitch, yaw, and roll). In some embodiments, the IMU 540 rapidly samples the measurement signals and calculates the estimated current position of the headset 505 from the sampled data. For example, the IMU 540 integrates the measurement signals received from the accelerometers over time to estimate a velocity vector and integrates the velocity vector over time to determine an estimated current position of a reference point on the headset 505. Alternatively, the IMU 540 provides the sampled measurement signals to the console 510, which interprets the data to reduce error. The reference point is a point that may be used to describe the position of the headset 505. The reference point may generally be defined as a point in space or a position related to the eyewear device's 505 orientation and position.

The I/O interface 515 is a device that allows a user to send action requests and receive responses from the console 510. An action request is a request to perform a particular action. For example, an action request may be an instruction to start or end capture of image or video data, or an instruction to perform a particular action within an application. The I/O interface 515 may include one or more input devices. Example input devices include: a keyboard, a mouse, a hand controller, or any other suitable device for receiving action requests and communicating the action requests to the console 510. An action request received by the I/O interface 515 is communicated to the console 510, which performs an action corresponding to the action request. In some embodiments, the I/O interface 515 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action. The I/O interface 515 may monitor one or more input responses from the user for use in determining a perceived origin direction and/or perceived origin location of audio content.

The console 510 provides content to the headset 505 for processing in accordance with information received from one or more of: the headset 505 and the I/O interface 515. In the example shown in FIG. 5, the console 510 includes an application store 550, a tracking module 555 and an engine 545. Some embodiments of the console 510 have different modules or components than those described in conjunction with FIG. 5. Similarly, the functions further described below may be distributed among components of the console 510 in a different manner than described in conjunction with FIG. 5.

The application store 550 stores one or more applications for execution by the console 510. An application is a group of instructions, that when executed by a processor, generates content for presentation to the user. Content generated by an application may be in response to inputs received from the user via movement of the headset 505 or the I/O interface 515. Examples of applications include: gaming applications, conferencing applications, video playback applications, or other suitable applications.

The tracking module 555 calibrates the system environment 500 using one or more calibration parameters and may adjust one or more calibration parameters to reduce error in determination of the position of the headset 505 or of the I/O interface 515. Calibration performed by the tracking module 555 also accounts for information received from the IMU 540 in the headset 505 and/or an IMU 540 included in the I/O interface 515. Additionally, if tracking of the headset 505 is lost, the tracking module 555 may re-calibrate some or all of the system environment 500.

The tracking module 555 tracks movements of the headset 505 or of the I/O interface 515 using information from the one or more position sensors 535, the IMU 540, the DCA 520, or some combination thereof. For example, the tracking module 555 determines a position of a reference point of the headset 505 in a mapping of a local area based on information from the headset 505. The tracking module 555 may also determine positions of the reference point of the headset 505 or a reference point of the I/O interface 515 using data indicating a position of the headset 505 from the IMU 540 or using data indicating a position of the I/O interface 515 from an IMU 540 included in the I/O interface 515, respectively. Additionally, in some embodiments, the tracking module 555 may use portions of data indicating a position or the headset 505 from the IMU 540 to predict a future position of the headset 505. The tracking module 555 provides the estimated or predicted future position of the headset 505 or the I/O interface 515 to the engine 545. In some embodiments, the tracking module 555 may provide tracking information to the audio system 300 for use in generating the sound field reproduction filters.

The engine 545 also executes applications within the system environment 500 and receives position information, acceleration information, velocity information, predicted future positions, or some combination thereof, of the headset 505 from the tracking module 555. Based on the received information, the engine 545 determines content to provide to the headset 505 for presentation to the user. For example, if the received information indicates that the user has looked to the left, the engine 545 generates content for the headset 505 that mirrors the user's movement in a virtual environment or in an environment augmenting the local area with additional content. Additionally, the engine 545 performs an action within an application executing on the console 510 in response to an action request received from the I/O interface 515 and provides feedback to the user that the action was performed. The provided feedback may be visual or audible feedback via the headset 505 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

receiving sounds detected by a microphone array from one or more sound sources in a local area of the microphone array;

estimating array transfer functions (ATFs) associated with the sounds;

determining sound field reproduction filters for a loudspeaker array using the ATFs; and providing the sound field reproduction filters to the loudspeaker array, wherein audio content presented according to the sound field reproduction filters has a sound field that has a reduced amplitude in a first damped region of the local area.

2. The method of claim 1, wherein determining the sound field reproduction filters for the loudspeaker array using the ATFs, comprises:

applying an optimization algorithm to the ATFs, the optimization algorithm subject to one or more constraints.

3. The method of claim 2, wherein a constraint of the one or more constraints is that the audio content is provided to ears of a user.

4. The method of claim 2, wherein the optimization algorithm also uses a relative location of the one or more sound sources to the loudspeaker array to determine the sound field reproduction filters.

5. The method of claim 2, further comprising:

classifying the ATFs based on predicted types of the one or more sound sources as human type or non-human type, and wherein the classification of each of the ATFs is a constraint of the one or more constraints.

6. The method of claim 5, wherein applying the optimization algorithm to the ATFs is such that an energy of a sum energies of the ATFs classified as human type is minimized.

7. The method of claim 5, wherein the first sound source is classified as a human type and the one or more sound sources also includes a second sound source that is classified as non-human type, and the sound field reproduction filters are such that the sound field that has a first amplitude in the first damped region of the local area that includes the first sound source and a second amplitude in a second damped region of the local area that includes the second sound source.

8. The method of claim 1, wherein the sounds include a first set of sounds detected over a first time period, the method further comprising:

receiving additional sounds detected over a second time period subsequent to the first time period by the microphone array from the one or more sound sources in the local area of the microphone array;

estimating additional ATFs associated with the additional sounds, the additional ATFs indicating a change in a location of the first sound source relative to a location of the microphone array from the first time period to the second time period;

updating the sound field reproduction filters for the loudspeaker array using the additional ATFs; and providing the updated sound field reproduction filters to the loudspeaker array, wherein audio content presented according to the updated sound field reproduction filters has a sound field that has a reduced amplitude in a second damped region of the local area that includes the first source.

9. The method of claim 8, wherein a location of the first sound source is the same in the first time period and the second time period, and a location of the microphone array changes from the first time period to the second time period.

10. The method of claim 8, wherein a location of the microphone array is the same in the first time period and the second time period, and a location of the first sound source changes from the first time period to the second time period.

11. The method of claim 1, wherein the loudspeaker array includes a plurality of acoustic emission locations and the microphone array includes a plurality of acoustic detection locations, and each acoustic detection location substantially collocated with a corresponding acoustic emission location.

12. The method of claim 11, wherein substantially collocated refers to each acoustic detection location being less than a quarter wavelength away from the corresponding acoustic emission location.

13. The method of claim 11, wherein an acoustic emission location is a port in a frame of a headset, the port providing an outcoupling point of sound from an acoustic waveguide that separates a speaker of the loudspeaker array from the port, wherein sound emitted from the speaker travels through the acoustic waveguide and is then emitted by the port into the local area.

14. A non-transitory computer-readable storage medium storing instructions that, when executed by a processor, cause the processor to perform operations comprising:

receiving sounds detected by a microphone array from one or more sound sources in a local area of the microphone array;

estimating array transfer functions (ATFs) associated with the sounds;

determining sound field reproduction filters for a loudspeaker array using the ATFs; and providing the sound field reproduction filters to the loudspeaker array, wherein audio content presented according to the sound field reproduction filters has a sound field that has a reduced amplitude in a first damped region of the local area.

15. The storage medium of claim 14, wherein determining the sound field reproduction filters for the loudspeaker array using the ATFs, comprises:

applying an optimization algorithm to the ATFs, the optimization algorithm subject to one or more constraints.

16. The storage medium of claim 15, wherein the optimization algorithm also uses a relative location of the one or more sound sources to the loudspeaker array to determine the sound field reproduction filters.

17. The storage medium of claim 15, the operations further comprising:

classifying the ATFs based on predicted types of the one or more sound sources as human type or non-human type, and wherein the classification of each of the ATFs is a constraint of the one or more constraints.

18. The storage medium of claim 17, wherein the first sound source is classified as a human type and the one or more sound sources also includes a second sound source that is classified as non-human type, and the sound field reproduction filters are such that the sound field that has a first amplitude in the first damped region of the local area that includes the first sound source and a second amplitude in a second damped region of the local area that includes the second sound source.

19. The storage medium of claim 14, wherein the sounds include a first set of sounds detected over a first time period, the operations further comprising:

receiving additional sounds detected over a second time period subsequent to the first time period by the microphone array from the one or more sound sources in the local area of the microphone array;

estimating additional ATFs associated with the additional sounds, the additional ATFs indicating a change in a location of the first sound source relative to a location of the microphone array from the first time period to the second time period;

updating the sound field reproduction filters for the loudspeaker array using the additional ATFs; and providing the updated sound field reproduction filters to the loudspeaker array, wherein audio content presented according to the updated sound field reproduction filters has a sound field that has a reduced amplitude in a second damped region of the local area that includes the first source.

20. The storage medium of claim 14, wherein the loudspeaker array includes a plurality of acoustic emission locations, wherein an acoustic emission location is a port in a frame of a headset, the port providing an outcoupling point of sound from an acoustic waveguide that separates a speaker of the loudspeaker array from the port, wherein sound emitted from the speaker travels through the acoustic waveguide.

* * * * *